US005137332A

United States Patent [19]

Gualtierotti et al.

[11] Patent Number: 5,137,332

[45] Date of Patent: Aug. 11, 1992

[54] SEATING SYSTEM WITH POSITIONABLE SUPPORTS AND AUXILIARY DEVICE

[75] Inventors: Gianfranco Gualtierotti; Alessandro M. D. Stelle, both of Nova Milanes, Italy

[73] Assignee: Zanotta S.p.A., Italy

[21] Appl. No.: 384,771

[22] Filed: Jul. 21, 1989

[30] Foreign Application Priority Data

Jul. 21, 1988 [IT] Italy ..... 21435 A/88

[51] Int. Cl.[5] ..... A47C 7/00

[52] U.S. Cl. ..... 297/443; 297/445; 297/440

[58] Field of Search ..... 297/443, 440, 451, 445, 297/397, 394, 404, 414, 416

[56] References Cited

U.S. PATENT DOCUMENTS

| | | | |
|---|---|---|---|
| 497,696 | 5/1893 | Wenzel | 297/443 X |
| 570,207 | 10/1896 | Harry | 297/443 X |
| 950,719 | 3/1910 | Ellsworth | 297/443 X |
| 1,005,080 | 10/1911 | Storm | 297/443 X |
| 3,827,751 | 8/1974 | Wiberg | 297/440 |
| 4,022,507 | 5/1977 | Smith et al. | 297/416 X |
| 4,596,423 | 6/1986 | Towns et al. | 297/443 X |

FOREIGN PATENT DOCUMENTS

| | | | |
|---|---|---|---|
| 1204898 | 1/1960 | France | 297/440 |
| 75750 | 6/1961 | France | 297/451 |
| 1532516 | 7/1968 | France | 297/440 |
| 82812 | 11/1953 | Norway | 297/445 |
| 420327 | 11/1934 | United Kingdom | 297/451 |

*Primary Examiner*—José V. Chen

*Attorney, Agent, or Firm*—Kirschstein, Ottinger, Israel & Schiffmiller

[57] ABSTRACT

A sofa or similar seating with backrests, armrests or additional fixtures that can be positioned as desired relative to the seating, while providing a platform-like basic structure that accommodates the upholstery so as to form the seat surface, with which backrests and/or armrests and/or additional fixtures are connected through a U-shaped element that is preferably of metal tubing, the free ends of this element being connected with the backrests, armrests or additional fixtures and the U-shaped element is of a curved shape as viewed from the side, this forming contact points for the element on the floor, with the end of the element that is bent upwards resting on the underside of the base plate of the sofa so as to form a backing therefor.

18 Claims, 8 Drawing Sheets

SEATING SYSTEM WITH POSITIONABLE SUPPORTS AND AUXILIARY DEVICE

BACKGROUND OF THE INVENTION

1. Field of the Invention

The present invention relates to a sofa or a similar seating with a backrest, armrests, and other additional fixtures, the position of which can be arranged as desired relative to the sofa. In addition, the invention relates, in general, to additional devices or fixtures that can be positioned as desired relative to a basic body of a seat.

2. Description of Related Art

In general, sofas today are built as a type of couch, which is to say, they incorporate a basic body that accommodates a mattress, in which case there are neither backrests nor armrests incorporated therein.

Also known are sofas that have a dish-shaped basic body that creates a surface that is used to hold the upholstered seat, and this is combined with high sides that then form the arm rests. In addition, the basic body also has an associated, nearly vertical wall section that serves to accommodate upholstery so as to form a backrest.

A conventional sofa that is constructed in this manner entails the disadvantage that it has a rigid structure that leaves free space in its interior architecture that make it possible to undertake configurational changes, and/or to incorporate a different number of backrests and/or arm rests. A further disadvantage of classic sofas is that the backrest is usually arranged along a long side of the basic body, with the armrests being perpendicular to this straight surface. In this case, it is thus not possible to vary the position of the upholstered parts of the backrest or the armrests relative to the basic body of the sofa.

A further disadvantage of the known sofa is that both the basic frame of the seating and the upholstery for the seats and armrests, as well as the upholstery for the backrest, is of the same material and of the same colour, which leads to a further restriction of the effect that can be achieved in both the design and the aesthetic sense.

SUMMARY OF THE INVENTION

It is the task of the present invention to create a sofa or similar seating of a new construction, with which it is possible to avoid the disadvantages inherent in the prior art.

This task has been solved with a sofa or seating such that a platform-like basic body is provided, this body accommodating the upholstery so as to form a seat, backrests and/or armrests and/or additional fixtures being associated with this basic body, these being connected by means of a U-shaped tubular curved element, the free ends of which are attached to the backrests, armrests, or additional fixtures, and the U-shaped tubular curved element being arc-shaped in side view, there being two points of contact for the element on the floor and a contact point on the under surface of the platform structure of the sofa to form a backing therefor.

This type of accommodation for a backrest or armrests or an additional fixture makes it possible to combine any number of backrests, armrests or additional fixtures with the basic frame of the sofa. Both the backrests and the armrests can be moved as desired and the position of these can be adjusted as desired relative to the basic body of the sofa. A spring action is imparted to the backrests and the armrests, and the backrests and armrests can not only be adjusted as desired relative to the basic body of the sofa, but can also be removed very simply.

The additional fixtures that are associated with the basic body of the seating consist, for example, of a horizontally arranged supporting surface, with which the free ends of the U-element can be connected so as to form a table, a supporting surface, a shelf for a lamp, etc.

BRIEF DESCRIPTION OF THE DRAWINGS

Further advantages of the invention are set out in the subclaims. The invention will be described in greater detail below on the basis of embodiments shown in the drawings appended hereto and which show the following:

DETAILED DESCRIPTION OF THE PREFERRED EMBODIMENTS

Figure 1:
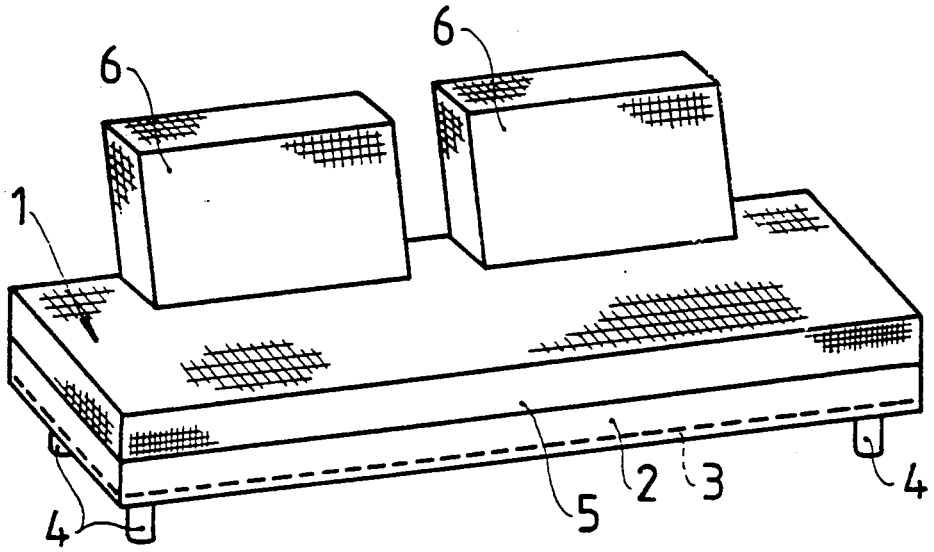
FIG. 1: A perspective view of a sofa with two backrests.
Figure 2:
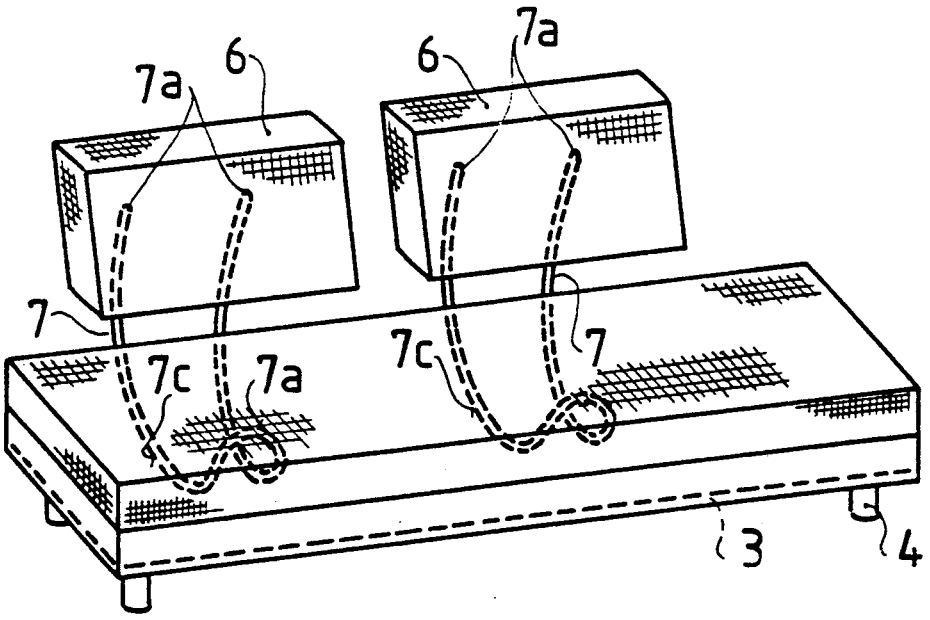
FIG. 2: The sofa as in FIG. 1, wherein the special arrangement and configuration of the U-elements are shown by the broken lines.

As can be seen in FIG. 1, the sofa or seat 1 according to the present invention comprises a basic body, to which the back rests 6 are associated. Both the backrests 6 and the armrests 8 are accommodated by U-shaped supports 7.

The element 7 is U-shaped and produced from metal tubing; this has two free ends 7*a* that are joined to the backrests 6 or the armrests 8. The element 7 is (as viewed from the front) not only U-shaped or V-shaped but, viewed from the side, is arcuate. The tip 7*b* of the element 7 lies on the underside of the basic body 3 the part of the arc numbered 7*c* lying on the floor.

This special configuration of the tubular element 7 to accommodate the backrest 6 makes it possible to slide the parts 7*b*, 7*c* of element 7 beneath the platform-shaped basic frame 3. This can be brought into contact with the basic body 3 of the sofa by slightly tilting the end piece 7*b*, when the section 7*c* lies as a sort of pivot point on the floor. When the user leans back against the backrest 7, because of the reaction of the element, the end piece 7*b* of the element is pressed firmly against the base frame 3 of the seat. The single point of contact of the element 7 on the floor is the section 7*c* of the arc, this then serving as a pivot point, whereas the free ends 7*a* of the element 7 permit an elastic, sprung movement of the backrest 6.

Figure 3:
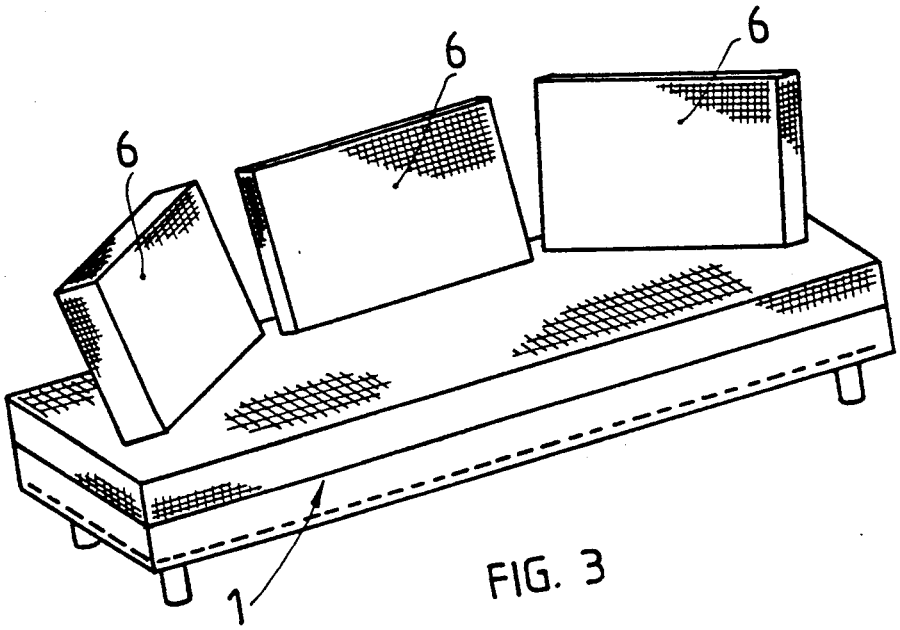
FIG. 3: The sofa as in FIG. 1, with three backrests that are arranged at different angles relative to the basic body of the sofa.
Figure 4:
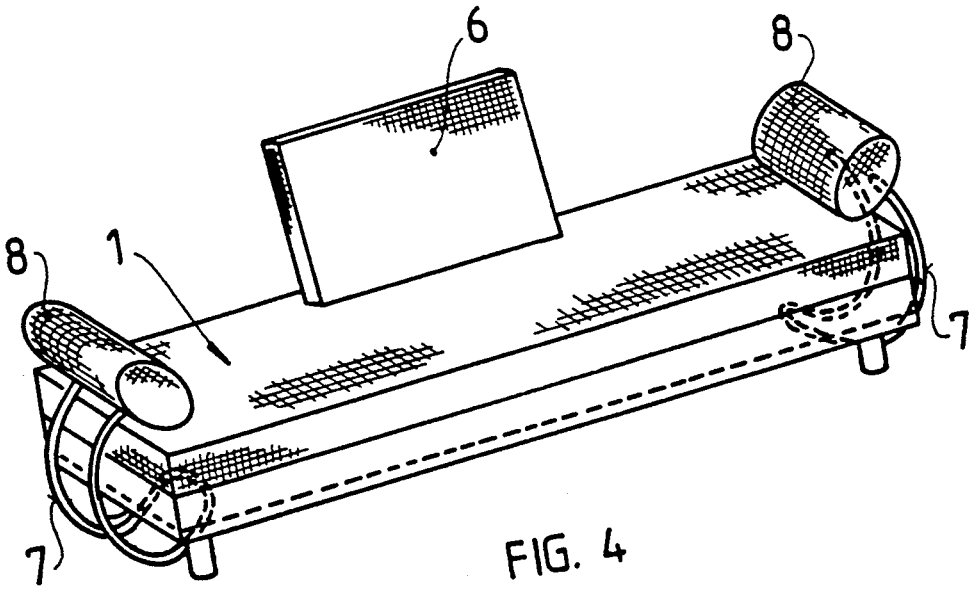
FIG. 4: A sofa as in FIG. 1 with two armrests.

FIG. 3 shows a sofa 1 that is fitted with three backrests 6, these being arranged at different angles to the seat surface of the sofa 1. FIG. 4 shows a sofa that is fitted with a single backrest 6 and with armrests 8 on the narrow sides of the sofa 1, these also being fitted with elements 7. The armrests 8 can also be configured as headrests.

Figure 5:
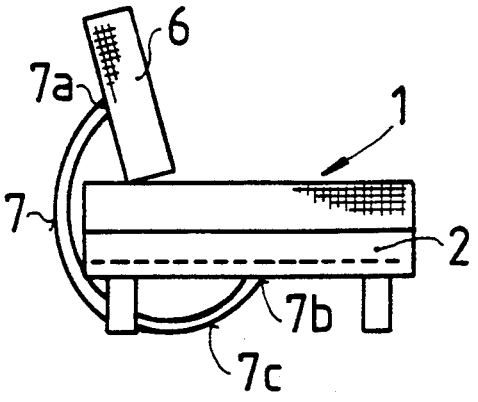
FIG. 5: A side view of the basic body of the sofa with a backrest, with a backrest that has been moved towards the inside of the seat surface.
Figure 6:
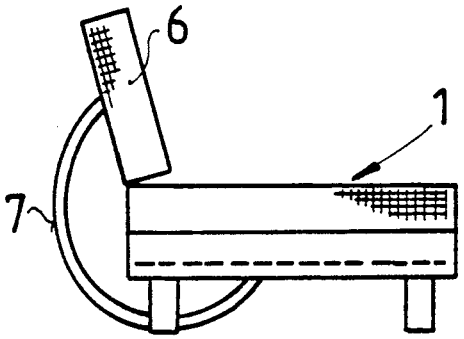
FIG. 6: The sofa as in FIG. 5, with the backrest moved to the outside of the seat surface.
Figure 7:
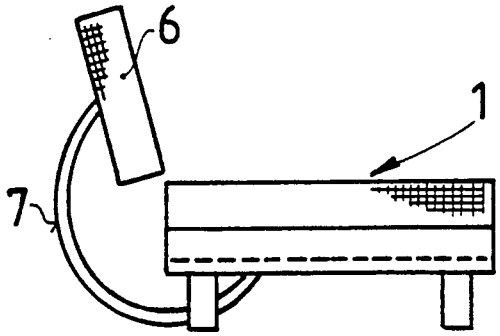
FIG. 7: The sofa as in FIG. 5, with the backrest arranged at a distance from the seat surface.

FIGS. 5 to 7 show a sofa 1 as viewed from the narrow side. In FIG. 5, the backrest 6 is arranged over the seat surface 2.

FIG. 6 shows that the backrest 6 can also be moved to the outer side of the seat surface 2.

FIG. 7 shows how the backrest 6 can be set at a distance from the base surface of the sofa 1, for example, in order to simplify cleaning.

Figure 8:
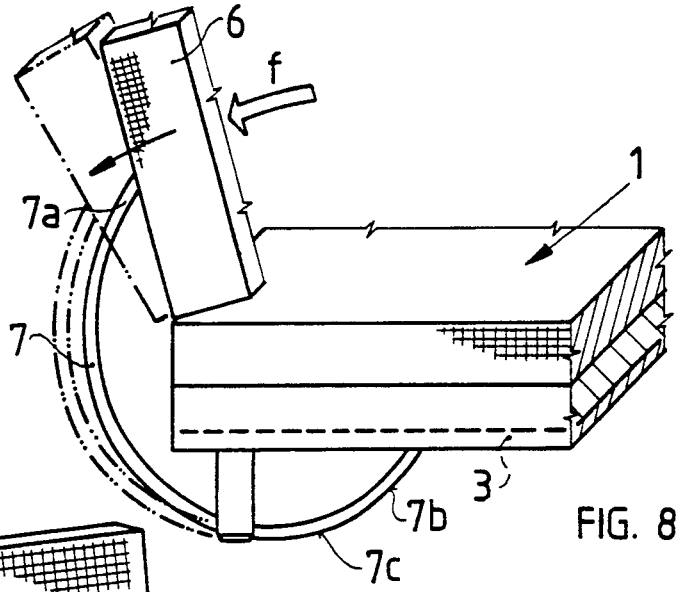
FIG. 8: A diagram that shows the spring action that can be achieved by using a tubular U-element according to the present invention.

FIG. 8 shows how the backrest 6 can be effectively connected through the element 7 with the base plate 3 of the sofa 1. From this drawing it can be seen that the end 7*b* of the element 7 can be connected with the under side of the base plate 3 of the sofa with, in contrast to this, the free ends 7*a* of the element being connected with the backrest 6. Because of the special embodiment of the element, which is advantageously produced from metal tubing, when a force f is applied to the backrest 6, the element can make a sprung movement from one position shown by continuous lines into a position that is indicated by dashed lines. This leads to a great increase in the confort provided for a person seated on the sofa and leaning against the backrest 6.

Figure 9:
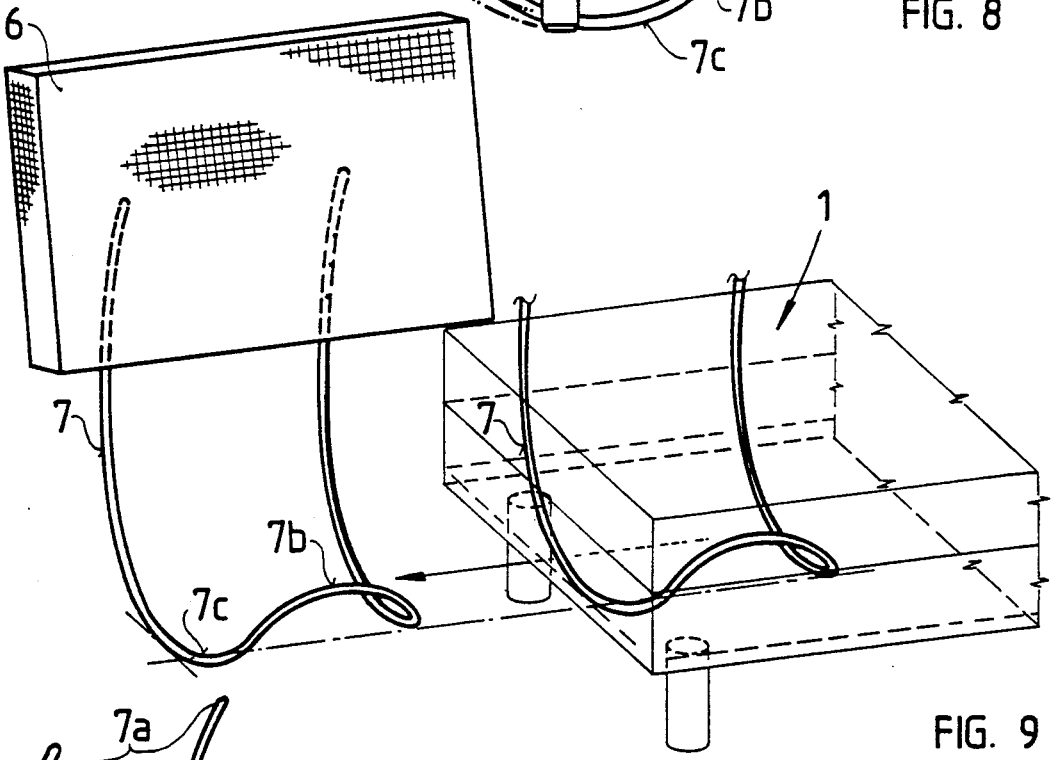
FIG. 9: A detail of the seat surface of the sofa with the U-element to accommodate the backrest, which is arranged beneath the basic frame of the sofa, and the U-element and the backrest at a distance from the seat surface of the sofa.

FIG. 9 is a perspective view of part of the base frame of the sofa 1, and also shows once again the parts 7*b* of the element 7, that is U- or V-shaped. The end 7*b* of the element 7 lies on the underside of the plate 3 of the basic frame of the sofa 1, whereas the arc-shaped part 7*c* of the element 7 lies on the floor.

In FIG. 9, the element 7 is shown at a distance from the base frame of the sofa 1 in the interests of greater clarity.

Figure 10A:
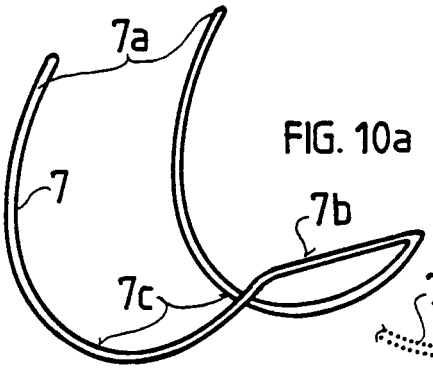
FIGS. 10*a*, 10*b*, 10*c* show various embodiments of the U-element.
Figure 10B:
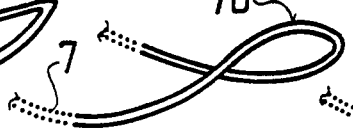
Figure 10C:
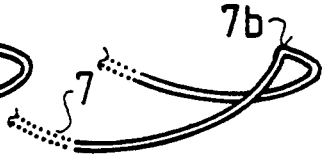

FIGS. 10*a*, 10*b*, and 10*c* show three possible embodiments of the lower part of the element 7.

As has already been discussed above, in an advantageous manner the element 7 is of metal tubing and the ends 7*a* can be joined to the backrest 6 or an armrest 8. The element 7 is not only configured so as to be U-shaped or V-shaped, but in side view it is of an arced shape. This forms two parts 7*a* of the arc, with which the element 7 lies on the floor P, the front tip 7*b* of the element lying on the underside of the base frame 3 of the sofa 1.

FIG. 10*a* shows an end 7*b* of the element 7 that is of an almost flat shape, although it could also be advantageous to configure the front piece 7*b* of the element 7 as in FIG. 10 *b* with a round shape, or even as in FIG. 10*c* with a pointed end 7*b*. The shape of the curve (7*c*) of the element 7 (as viewed from the side) can be matched, by the shape of its curve, to special and particular requirements.

Figure 11:
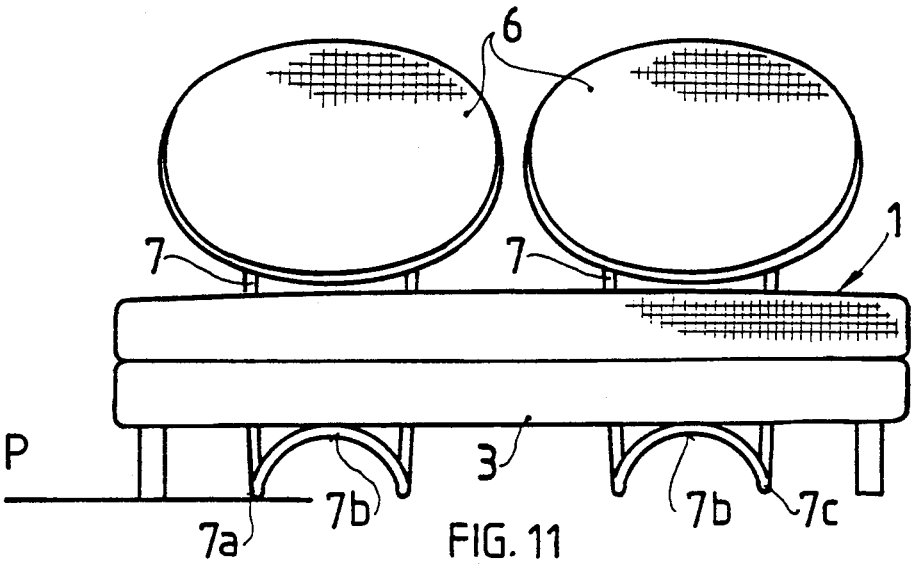
FIG. 11: A front view of the sofa with two oval backrests.

FIG. 11 shows the sofa 1 from the front. The backrests 6, which in this case are oval, are accommodated by the elements 7 and it is quite plain how the base piece 7*c* of each element 7 lies on the floor P. The end pieces 7*b* of the element lie on the under side of the base frame 3 of the sofa 1. Because of the inherent weight of the backrest 6 there is a constant load on the element 7 and this causes the element to pivot about the pivot points 7*c*, when means that the ends 7*b* of the element are pivoted upwards and pressed against the underside of the base frame 3 of the sofa 1.

Figure 12:
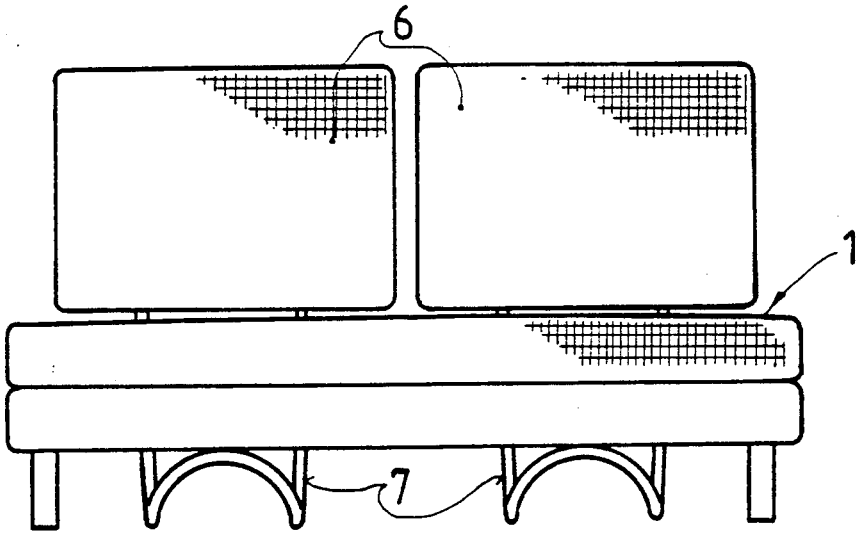
FIG. 12: The sofa as in FIG. 11 with two rectangular backrests.
Figure 13:
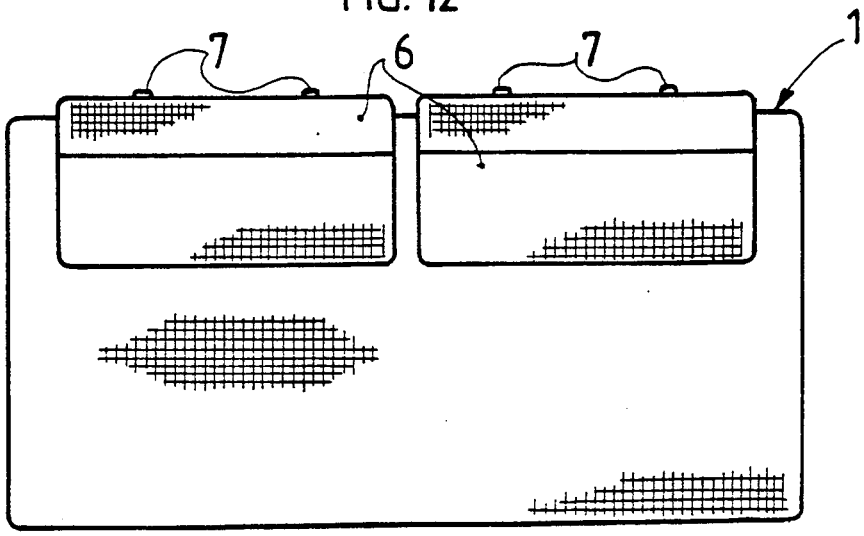
FIG. 13: The sofa as in FIG. 12 in plan view.

In FIG. 13, a sofa 1 is shown in front view. The sofa 1 is fitted with backrests 6 that are of rectangular shape. The sofa in FIG. 12 is shown once again, in plan view, in FIG. 13.

Figure 14:
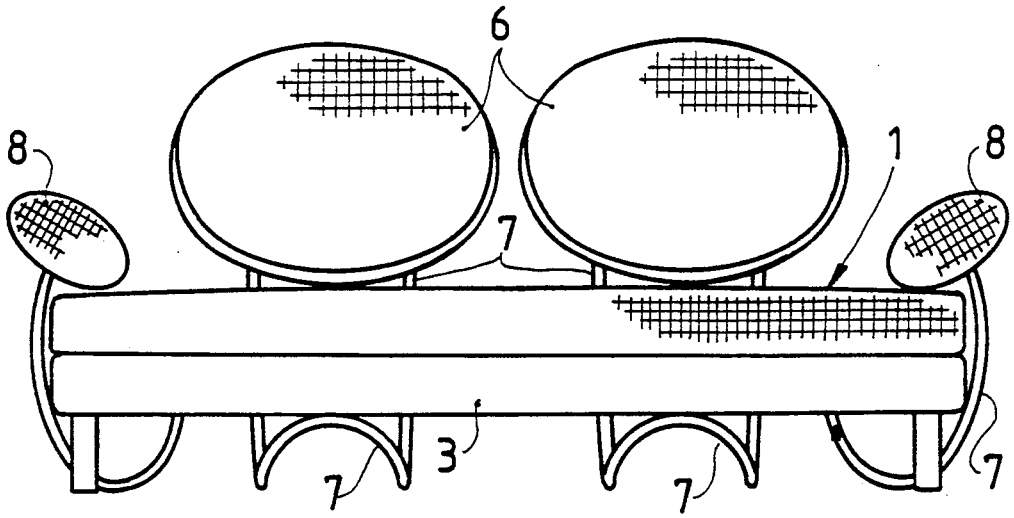
FIG. 14: The sofa with two oval backrests and two armrests at the sides.

FIG. 14 shows the sofa as in FIG. 11 in combination with armrests or headrests 8 arranged at the sides.

Figure 15:
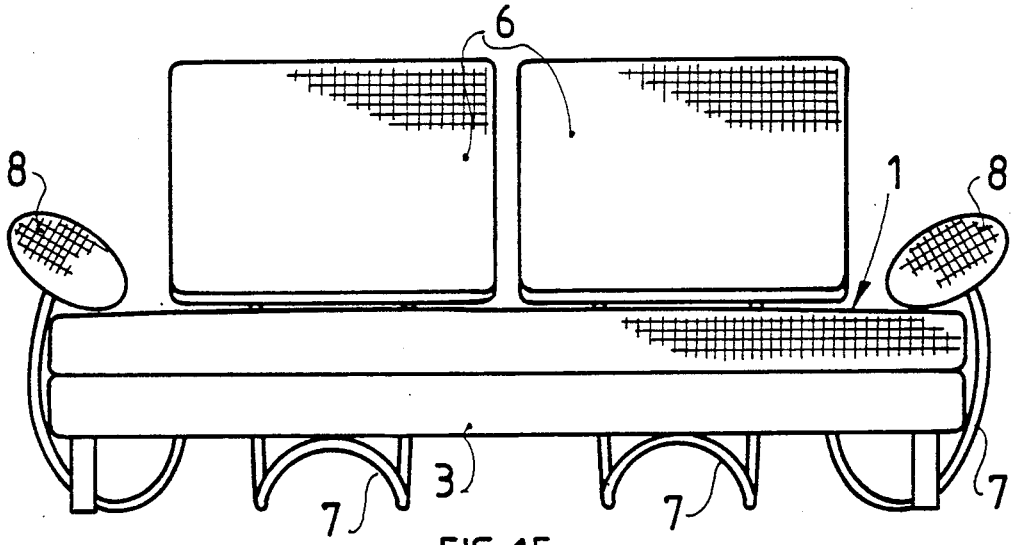
FIG. 15: The sofa with two rectangular backrests and two armrests at the sides.
Figure 16:
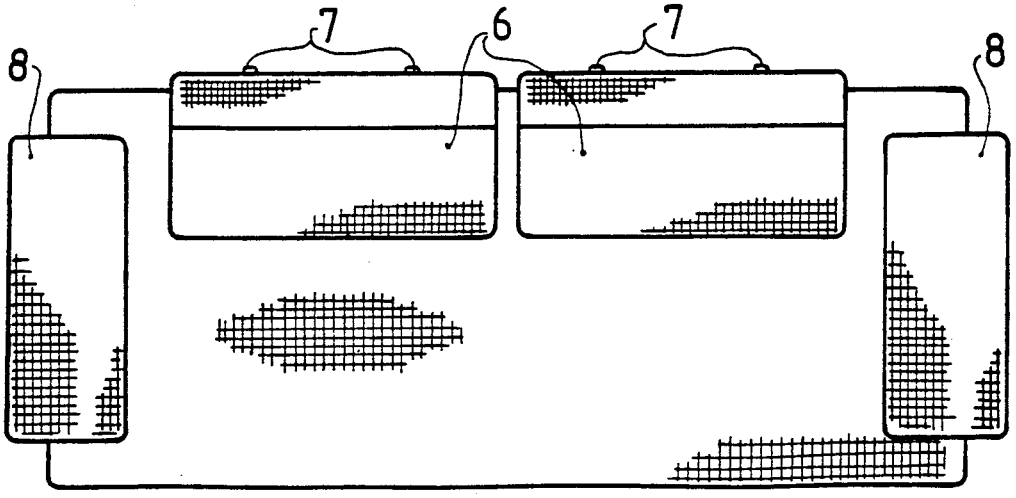
FIG. 16: The sofa as in FIG. 15 in plan view.

FIG. 15 shows the sofa as in FIG. 12 with armrests or headrests 8 arranged at the sides. The sofa as in FIG. 15 is shown once again, in plan view, in FIG. 15.

Figure 17:
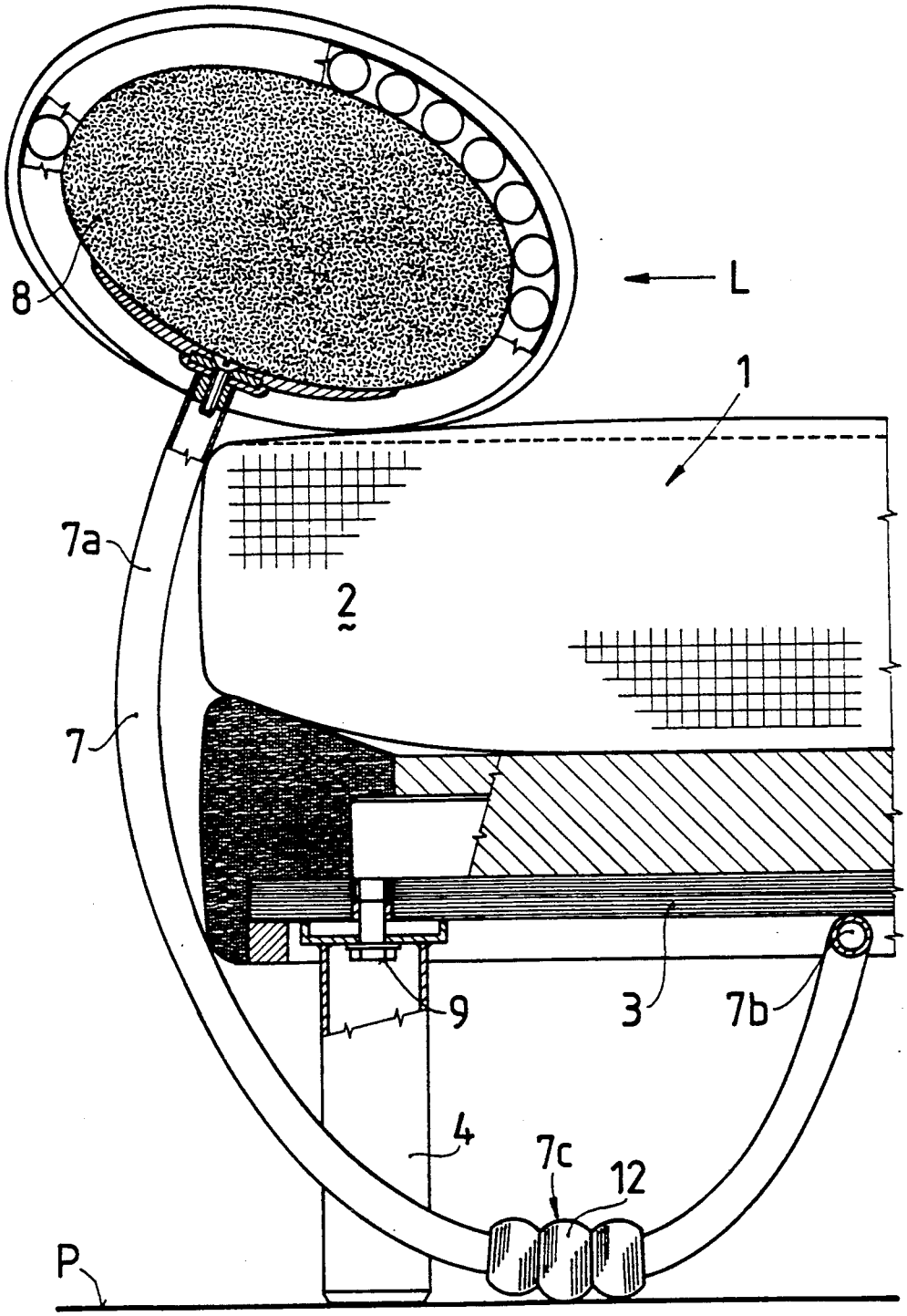
FIG. 17: A detail of the armrest with the associated U-element according to the present invention.

FIG. 17 shows a part of the sofa 1. The sofa 1 comprises, essentially, the base frame 3 that accommodates upholstery 2 in the form of a mattress or a cushion. The sofa 1 is supported on legs 4 that are connected through the screws 9 to the base frame 3. The armrest 8 (analogously to the backrest 6) consists of a moulded part 10 of polyurethane or a similar soft, elastic material, that is connected to a supporting panel 11 that is, in turn, secured to the element 7. Viewed from the front, the element 7 is of U-shape or V-shape according to the arrow L, and viewed from the side, as can be seen from FIG. 17, the element is arcuate. The element 7 is so curved that two free ends 7*a* are formed, and these are connected to the armrest 8 or a backrest 6. The end piece 7*b* of the element 7 lies on the underside of the base frame that is supported by the legs 4. The section 7*c* of the arc of the element 7 rests on the floor P.

In order to avoid the element 7 being moved by accident or unintentionally, or the element slipping unintentionally on the floor P, there are cushions 12 arranged on the section 7*c* of the arc 7, and these can be arranged, for example, in the form of a helical coil on the section 7*c* of the arc. These cushions 12 consist of non-skid material, for example, of rubber or plastic. By fitting such cushions, it is ensured that the section 7*c* of the arc 7 forms a steady and secure pivot point for the backrest or for the arm rest 8.

When a force acts on the armrest or the backrest 6, the element 7 will not slip on the floor P because of the pivoting movement of the two arms 7*a* of the element 7; rather, because of the non-skid cushions 12, the element will remain in its intended position, although an opposite, reactive force will be transferred to the ends 7*b* of the element, whereupon these will be pressed firmly against the underside of the base frame 3. Should it be necessary the end piece 7*b* of the element 7 can also be fitted with non-skid cushions 12.

In the description of the present invention provided heretofore, for the sake of simplicity, reference has been made to a sofa 1, although the teachings of the present invention also apply to other types of seating such as settees, loveseats, stools, and other such items of furniture.

Figure 18:
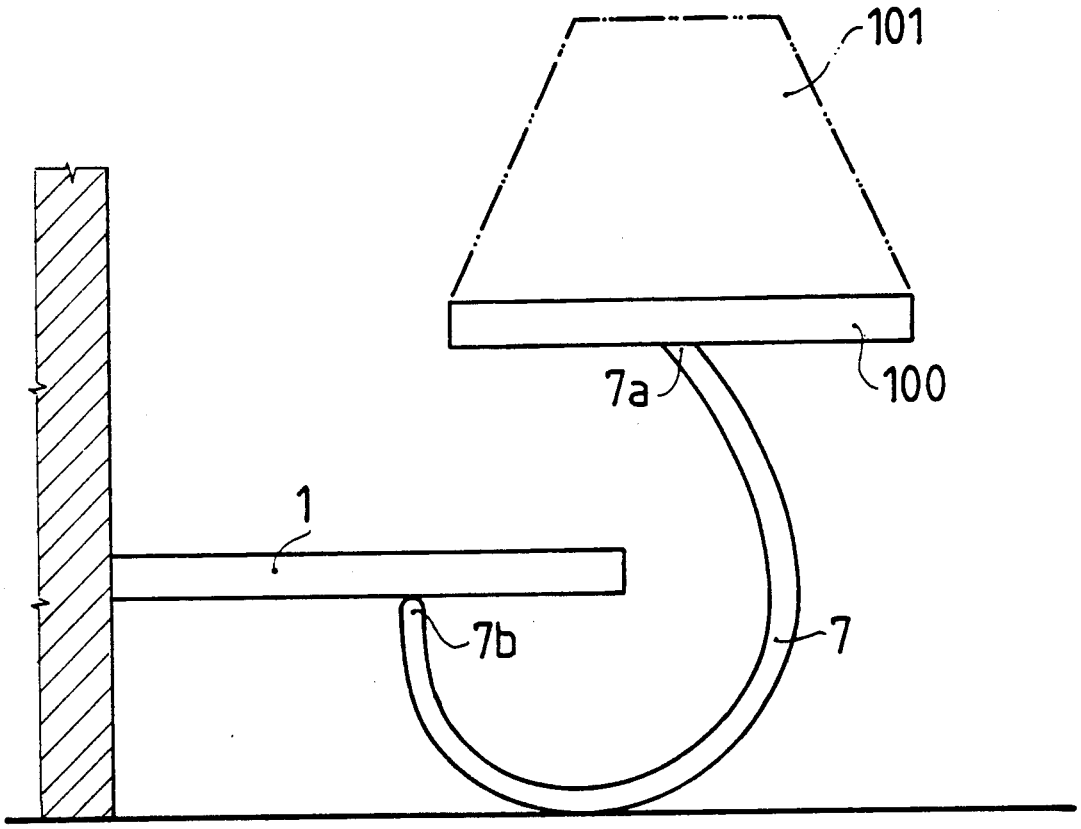
FIG. 18: A side view of an additional fixture for the sofa.

As can be seen from FIG. 18, the present invention not only makes it possible to produce seating with backrests, armrests, or headrests, the positions of which can be adjusted relative to the seat surface, but it also makes it possible to create additional fixtures of various kinds for the seating.

It can be seen from FIG. 18 that, as has already been described, a supporting surface is provided, against which the end *7b* of the element 7 rests in the manner described heretofore. The two ends *7a* of the element 7 are connected to a flat surface 100 so as to create an end table or a supporting surface. Furthermore, the end *7a* of the element 7 can also be connected with a lamp 101 that is indicated by the broken lines. Using this embodiment, that provides a fixed, flat surface 1, one can create a large number of additional fixtures, such as tables, end tables, supporting surfaces, book shelves and/or other supporting surface for lamps and the like, using the element 7 described heretofore.

We claim:

1. A seating arrangement, comprising:

a seat having a periphery, a top and a bottom;

means for elevating the bottom of the seat above the ground;

at least one adjunct support; and means for removably positioning said one adjunct support at any desired location about the periphery of the seat, said positioning means including an arcuate positioning lever have a first end portion connected to said one adjunct support, a second end portion detachably engaged with the elevated bottom of the seat, and a fulcrum portion between the end portions and supported on the ground, said second end portion pressing against the elevated bottom of the seat in a position of use and anchoring said one adjunct support at a desired location, said second end portion being movable out of pressing engagement with the elevated bottom of the seat to re-position said one adjunct support to another desired location.

2. The arrangement according to claim 1, wherein said first end portion of the positioning lever has a pair of arms spaced apart of one another.

3. The arrangement according to claim 1, wherein said second end portion has a closed end.

4. The arrangement according to claim 3, wherein the closed end has a linear configuration and linearly engages the elevated bottom of the seat.

5. The arrangement according to claim 3, wherein the closed end has a curved configuration and curvilinearly engages the elevated bottom of the seat.

6. The arrangement according to claim 3, wherein the closed end has a pointed configuration and pointedly engages the elevated bottom of the seat.

7. The arrangement according to claim 1, wherein said fulcrum portion has a pair of arms spaced apart of each other.

8. The arrangement according to claim 7, wherein the arms of the fulcrum portion are arcuate and engage the ground.

9. The arrangement according to claim 1, wherein the lever is constituted of a resilient tubing.

10. The arrangement according to claim 1, wherein said one adjunct support is a backrest.

11. The arrangement according to claim 1, wherein said one adjunct support is an armrest.

12. The arrangement according to claim 1, wherein said one adjunct support is a shelf.

13. The arrangement according to claim 1, wherein said one adjunct support is located above the top of the seat within the periphery of the seat.

14. The arrangement according to claim 1, wherein said one adjunct support is located above the top of the seat outside of the periphery of the seat.

15. The arrangement according to claim 1, wherein said one adjunct support is located above the top of the seat and spaced therefrom.

16. The arrangement according to claim 1, wherein the seat is upholstered, and wherein said one adjunct support has a core of a soft, elastic material mounted on a panel that is connected to said first end portion of the positioning lever.

17. The arrangement according to claim 1; and further comprising non-skid means on the positioning lever for resisting undesired pivoting movement of said second end portion of the positioning lever in the position of use.

18. The arrangement according to claim 17, wherein the non-skid means includes cushions on the fulcrum portion.

* * * * *